US006799337B1

(12) United States Patent
Raphael-Davis et al.

(10) Patent No.: US 6,799,337 B1
(45) Date of Patent: Oct. 5, 2004

(54) BABY CRIB ATTACHMENTS

(76) Inventors: Danielle Raphael-Davis, 1009 Moorefield Hill Grove, Vienna, VA (US) 22180; Haden Davis, 1009 Moorefield Hill Grove, Vienna, VA (US) 22180

( * ) Notice: Subject to any disclaimer, the term of this patent is extended or adjusted under 35 U.S.C. 154(b) by 0 days.

(21) Appl. No.: 10/413,558

(22) Filed: Apr. 15, 2003

(51) Int. Cl.[7] ..... A47D 9/00
(52) U.S. Cl. ..... 5/93.1; 5/658; 5/663
(58) Field of Search ..... 5/93.1, 658, 946, 5/663; 297/181; 206/457; 229/116.1; 446/488, 227, 369

(56) References Cited

U.S. PATENT DOCUMENTS

| | | | | |
|---|---|---|---|---|
| 4,594,072 A | | 6/1986 | Cowell | |
| 4,800,600 A | * | 1/1989 | Baum | 5/93.1 |
| 4,873,734 A | | 10/1989 | Pollard | |
| 4,890,346 A | | 1/1990 | Rist | |
| 4,945,584 A | | 8/1990 | LaMantia | |
| 4,968,279 A | | 11/1990 | Smith | |
| 5,137,335 A | * | 8/1992 | Marten | 297/485 |
| D351,756 S | | 10/1994 | Miller et al. | |
| 5,699,564 A | | 12/1997 | Heh | |
| 5,706,534 A | | 1/1998 | Sherman | |
| 5,926,873 A | * | 7/1999 | Fountain | 5/424 |
| 5,933,885 A | | 8/1999 | Glassford | |
| 6,026,528 A | * | 2/2000 | Pina | 5/658 |
| 6,113,454 A | * | 9/2000 | Mitchell | 446/227 |
| 6,170,101 B1 | | 1/2001 | McCloud | |
| D442,811 S | | 5/2001 | Delaplaine et al. | |
| 6,301,731 B1 | | 10/2001 | Jakubowski et al. | |
| 2001/0000362 A1 | | 4/2001 | Wagner et al. | |
| 2002/0026669 A1 | | 3/2002 | Carroll | |

FOREIGN PATENT DOCUMENTS

| | | |
|---|---|---|
| GB | 2295770 | 6/1996 |

OTHER PUBLICATIONS

Cover From *Juvenile Lifestyles, Inc.* Catalog, Specific Date Unknown.
Printout From www.ababysheaven.com Website, printed on Feb. 24, 2003.

* cited by examiner

*Primary Examiner*—Teri Pham Luu
*Assistant Examiner*—Fredrick Conley
(74) *Attorney, Agent, or Firm*—Richard C. Litman

(57) ABSTRACT

A series of embodiments of attachments for a baby crib or other article of furniture provides various representations or caricatures of various animals or other objects or articles, e.g., "rubber ducky," carousel animals, railroad train engine, etc. The present attachments comprise at least one, and preferably a series of, three dimensional or bas-relief panels shaped by padding, upholstery, and/or inflation, as desired. The panels are removably attached to a crib or the like by plastic ties, hook and loop material, buttons, or snaps, as desired. A coherent theme is provided where multiple panels are used. Upper, adult accessible storage pockets and/or lower, toddler accessible pockets are also provided in at least one of the panels of each set.

19 Claims, 8 Drawing Sheets

BABY CRIB ATTACHMENTS

BACKGROUND OF THE INVENTION

1. Field of the Invention

The present invention relates generally to accessories for articles of furniture, and more particularly to a series of embodiments of attachments for a baby crib or similar article. The present baby crib attachments comprise a series of decorative panels which secure removably to the exterior of the crib, and which provide adult accessible storage pockets and infant or toddler accessible pockets for toys and the like, as well as other features. The attachments may comprise various caricatures or other representations, and include padding and/or upholstery to provide a limited three-dimensional or bas-relief appearance.

2. Description of the Related Art

The need for safe, secure, and comfortable bedding for infants, toddlers, and small children has long been recognized. Accordingly, a number of smaller cribs, cradles, bassinettes, and similar small beds have been developed in the past for infants and small children. Most of these devices are reasonably functional, with side rails and/or other features to contain and protect an infant or small child therein.

It was realized that additional comfort and protection could be provided by means of upholstery or padding disposed within the crib railing, to provide a soft surface between a child within the crib and the crib railing. These devices are known as "bumpers", and may include additional features such as decorative or educational elements, etc.

However, very few devices have been developed for attachment to the outside of a crib or similar sleep furniture for an infant or small child. While innumerable quilts, coverlets, and the like containing various designs or patterns thereon, e.g. trains, airplanes, western motifs, etc., have been developed in the past, these articles cannot be applied to a crib or the like, with its relatively high railings. Other devices have been developed to hang over a crib or attach to the side railings of a crib, e.g., mobiles, toys, mirrors, etc., to stimulate an infant or child contained within the crib or similar bedding. However, these devices do nothing to alter the external appearance of the crib.

Another concern of at least some importance to most parents and caregivers of infants and small children is the need for convenient storage pockets or containers close at hand to the location of the child. Such pockets may be used to contain bottles, toys, diapers and accessories, medication and treatments, etc. as desired. As a result, a number of storage devices have been developed for attachment to a crib or the like, for containing articles used by an adult caregiver in the care of an infant or small child. However, these devices are generally not particularly decorative in their appearance.

Accordingly, a need will be seen for a series of decorative panels which may be removably attached to the various surfaces of a crib, cradle, or other structure as desired. The present invention responds to this need by means of a series of such panels which may be removably and interchangeably installed upon the exterior of a crib or the like, with the present panels providing a limited three dimensional or bas-relief effect due to their upholstery and padding. The present attachments include decorative elements or themes thereon, in various representations or caricatures (animals, vehicles, etc.). The present panels are also functional, as they include adult accessible pockets for containing various articles for the care of an infant or small child within the crib, and may further include infant or toddler accessible pockets for use by the child when not contained within the crib.

A discussion of the related art of which the present inventor is aware, and its differences and distinctions from the present invention, is provided below.

U.S. Pat. No. 4,594,072 issued on Jun. 10, 1986 to Robert L. Cowell, titled "Infant's Soft, Simulated Auto Dashboard," describes a relatively small, padded toy for installation to the inside of a crib railing or the like. The Cowell device is much too small to cover essentially the entire exterior of a crib or the like, and as the device is intended for installation within a crib, the attachment straps are much too short to position the device close to the floor for access by a crawling toddler. Moreover, no adult accessible storage pockets are provided.

U.S. Pat. No. 4,800,600 issued on Jan. 31, 1989 to Marilyn J. Baum, titled "Decorative Crib Bumper," describes a three-dimensional clown caricature for removable installation within a crib or the like. The caricature primarily comprises padded tubular elements resembling arms and legs, which substantially encircle the crib interior. The Baum device more closely resembles a conventional crib bumper, than it does the present invention which installs upon the exterior of the crib. Moreover, Baum does not disclose any form of adult or toddler accessible pockets or other elements on her crib bumper.

U.S. Pat. No. 4,873,734 issued on Oct. 17, 1989 to Dianne J. Pollard, titled "Bumper Sheet," describes a bed sheet having a series of elongate peripheral pockets therein. A corresponding series of padded or inflated elements are removably installed within the pockets, to serve as crib bumpers or the like. Pollard teaches away from the present invention, as there is no way to secure the Pollard elements to the exterior of a crib or other similar structure. Moreover, Pollard does not disclose any supplementary pockets for storing other articles, nor does she disclose any decorative elements.

U.S. Pat. No. 4,890,346 issued on Jan. 2, 1990 to Judith Rist, titled "Infant Crib Enclosure," describes a series of peripheral crib bumpers and an intermediate bumper which may be extended across the crib to partition the space into smaller areas. The Rist assembly more closely relates to a conventional crib bumper which installs within the crib, than to the present invention with its exterior installation.

U.S. Pat. No. 4,945,584 issued on Aug. 7, 1990 to Mark A. LaMantia, titled "Crib Cover," describes a tent-like structure for removable installation over the top of a crib or playpen. The LaMantia device includes opposed end panels which install within the end walls or panels of the crib or pen. No external panels, three dimensional padding, caricatures or representations of other articles, or adult or toddler accessible pockets are disclosed by LaMantia.

U.S. Pat. No. 4,968,279 issued on Nov. 6, 1990 to Rosemary Smith, titled "Infant Toy," describes a toy for hanging from a crib rail to the interior of the crib. No three dimensional padding or adult or toddler accessible pockets are disclosed by Smith. Moreover, the hanging straps for the Smith toy are much too short to position the toy close to the floor if the toy is suspended to the outside of the crib, thereby precluding access by a crawling toddler.

U.S. Pat. No. 5,699,564 issued on Dec. 23, 1997 to Deborah A. Heh, titled "Detachable Organizing Apparatus For Children Furniture," describes a basket which attaches removably to the exterior of a crib or other article of furniture. A removable inner liner is also provided for the basket. No decoration, caricatures, or representation of any other article is provided for the Heh basket, nor is any three dimensional padding or upholstery provided. The Heh basket is intended for use only by adult caretakers, with no access being provided for a toddler or small child.

U.S. Pat. No. 5,706,534 issued on Jan. 13, 1998 to Teresa K. Sherman, titled "Protective Bumper Pad," describes a device intended for use as a conventional bumper, installing to the inside of the crib sides and railing. An inwardly extending horizontal portion tucks beneath the crib mattress to secure the lower edges of the bumper pads, with conventional ties securing the upper portions of the pads to the crib bars and rails. The Sherman bumper cannot be secured to the exterior of the crib, due to the inwardly extending portion which secures beneath the mattress. Moreover, no adult or child accessible pockets are disclosed by Sherman.

U.S. Pat. No. 5,926,873 issued on Jul. 27, 1999 to Irene Fountain, titled "Crib Railing Guard," describes a crib bumper for installation within the side rails of a crib or the like. The Fountain device closely resembles the Sherman crib bumper discussed immediately above, with the exception of the means of securing the lower edges of the panels within the crib. The same points of distinction noted between the Sherman crib bumper and the present invention, are seen to apply here as well.

U.S. Pat. No. 5,933,885 issued on Aug. 10, 1999 to Clay T. Glassford, titled "Baby Crib Bumper," describes several embodiments of a crib bumper which installs within the interior of the crib. Most of the embodiments are similar to the Sherman bumper discussed further above, securing at least partially beneath the mattress. Glassford does not disclose any means of securing his bumper to the outside of the crib, nor any decorative caricatures or adult or child accessible pockets.

U.S. Pat. No. 6,026,528 issued on Feb. 22, 2000 to Lynn M. Pina, titled "Frame," describes a series of embodiments of a mirror or picture frame for installation within a crib. The Pina device provides for securing the lower edge thereof by a flap or tab which extends beneath the mattress, thereby obviating its installation to the outside of the crib. While the Pina device provides for the installation of a mirror or the like and an audio device therein, no storage pockets per se are provided.

U.S. Pat. No. 6,170,101 issued on Jan. 9, 2001 to Crystal W. McCloud, titled "See Through Protective Crib Cover Construction," describes yet another bumper for installation to the interior walls of a crib. The McCloud bumper includes a series of screened openings therethrough, enabling an infant or child within the crib to see outwardly. However, no caricatures or representations of other objects is provided in the overall appearance of the McCloud bumpers, nor is there any suggestion of attachment of the device to the exterior of a crib or the like.

U.S. Pat. No. 6,301,731 issued on Oct. 16, 2001 to Chris D. Jakubowski et al., titled "Infant Activity Panel," describes a playpen with removable interior panels. The panels include various decorative elements thereon, but no storage pockets of any sort are provided. While the present attachments may be adapted for installation upon the exterior of a playpen or other article, Jakubowski et al. do not disclose the installation of their panels on the exterior of the playpen, or any other device.

U.S. Patent Publication No. 2001/0000362A1 published on Apr. 26, 2001 to Allen S. Wagner et al., titled "Ventilated Crib Bumper," describes various embodiments of a bumper which secures conventionally to the interior panels of the crib. A screen or mesh band extends continually about the lower portion of the bumper, just above the crib mattress. The crib bumper of the Wagner et al. Patent Publication thus more closely resembles the crib bumper with mesh or screen openings disclosed in the McCloud '101 U.S. Patent, discussed further above, than it does the present invention.

U.S. Patent Publication No. 2002/0026669A1 published on Mar. 7, 2002 to Mary T. Carroll, titled "Apparatus And Method Of Using A Picture-Displaying Crib Bumper," describes a crib bumper having a series of display openings or ports therein for the removable insertion of photos, drawings, etc. The Carroll crib bumper installs to the inside of a crib, and more closely resembles the crib bumper with screened openings of the McCloud '101 U.S. Patent than it does the present invention.

U.S. Pat. No. D-351,756 issued on Oct. 25, 1994 to Christopher J. Miller et al., titled "Combined Bassinet Liner And Organizer," illustrates a design for a liner and cover which extends completely across the interior of the bassinet and partially downwardly over the exterior sides. The portion of the liner extending over the exterior includes a series of storage pockets therein. However, the Miller et al. bassinet liner is a unitary sheet of material, and cannot be separated into separate panels to cover different panels of a crib or the like. Moreover, no decorative representations or caricatures are disclosed by Miller et al., nor are any lower pockets or panels accessible by crawling toddlers apparent in the Miller et al. design. In addition, the Miller et al. bassinet liner design does not appear to have any padding or upholstery to provide a three dimensional effect upon the limited exterior surface panels.

U.S. Pat. No. D-442,811 issued on May 29, 2001 to Louise S. Delaplaine et al., titled "Crib Bumper With Pockets," illustrates a design for a bumper having a continuous series of open top storage pockets for access by an infant or small child within the crib. By definition, crib bumpers install to the inside of the crib. Delaplaine et al. do not suggest that their crib bumper will install to the exterior of the crib, as do the present crib attachments. Moreover, only one row of pockets is provided by Delaplaine et al., rather than an upper row for access by adults and a lower series for access by toddlers. Also, Delaplaine et al. do not disclose any representation or caricature formed along their crib bumper design.

British Patent Publication No. 2,295,770 published on Jun. 12, 1996 to Peter J. Horsey et al., titled "Protective Arrangement For Infant Cots Or Cribs," describes a series of padded cylindrical rolls which open along one side to secure about each of the vertical bars conventionally used in the construction of a child's crib. Horsey et al. do not provide continuous panels which extend over the exterior of the crib, nor do they provide any form of adult or toddler accessible pockets.

The present inventors are also aware of a crib or cradle attachment developed by Juvenile Lifestyles, Inc. in the late 1980s to early 1990s. The Juvenile Lifestyles crib enclosure is somewhat elaborate, having the appearance of a large swan with the child's crib or cradle enclosed in the center. The various panels are relatively thick and bulky, with the winged side panels making it somewhat difficult to attend to a child within the crib or cradle. The panels extend well beyond the upper edge of the crib, and are sufficiently bulky that it would be difficult to lower the side(s) of the crib, if so desired. Moreover, no pockets of any sort are apparent in the Juvenile Lifestyles crib attachment, either for access by adults or by toddlers at a lower level.

Finally, the present inventors are aware of various crib attachments disclosed on a website by Baby's Heaven (www.ababysheaven.com). Various crib attachments are disclosed in the website, including devices which attach to the outside of the crib and which include various storage pockets. However, no continuous series of panels forming an overall caricature or representation of another object, is disclosed in the Baby's Heaven website.

None of the above inventions and patents, taken either singly or in combination, is seen to describe the instant invention as claimed. Thus baby crib attachments solving the aforementioned problems are desired.

SUMMARY OF THE INVENTION

The present invention comprises a series of embodiments of decorative and functional attachments for a baby crib or similar article of furniture. The present crib attachments are a series of decorative panels which may be removably secured to one or more (preferably most or all) of the exterior sides of a baby crib or the like. The panels may be integrated to form a coherent theme, as by having the panels collectively form a representation of some object, animal, or other article as desired. Preferably, at least some of the panels are padded or upholstered to form a three-dimensional or bas-relief effect.

One or more of the panels may include relatively highly placed storage pockets thereon, for the storage of various articles which may be required by an adult caregiver for caring for an infant or small child within the crib. Additional lower pockets may be provided in one or more of the panels, for access by a crawling toddler or other small child. The panels preferably attach to the crib structure by means of sturdy plastic ties, or straps or tabs equipped with a heavy duty hook and loop fastener material (e.g., industrial grade Velcro®), or zippers, snaps, or buttons or the like, which are more durable and less prone to tampering or removal by small children than are conventional ties and the like. The present crib attachments are particularly adaptable for use with conventionally shaped rectangular cribs, but may be adapted to round or other crib shapes as desired.

Accordingly, it is a principal object of the invention to provide attachments for a baby crib or other article of furniture, which provide a representation of a caricature, animal, object, or other theme as desired.

It is another object of the invention to provide attachments for a baby crib in which one or more panels are upholstered or padded to provide a three-dimensional or bas-relief effect.

It is a further object of the invention to provide attachments for a baby crib including one or more upper storage pockets for access by an adult caregiver for an infant or small child contained within the crib.

Still another object of the invention is to provide attachments for a baby crib including one or more lower pockets for access by a crawling toddler or small child.

An additional object of the invention is to provide attachments for a baby crib which secure removably to the exterior of a crib by means of plastic ties, hook and loop fabric material, zippers, snaps, or buttons, and which avoid use of tie strings for attachment.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises several embodiments of attachments for furniture, and more particularly for a baby crib or the like. The present attachments include at least one panel, and preferably include two or more separate panels for removable installation upon a child's crib or the like. The panels of the present invention are formed of a soft, pliable, flexible material or materials, and are decoratively themed to provide a unified, coherent theme (e.g., an animal, vehicle, etc.) when installed upon the crib. Various attachment means, storage means, and other elements are also provided.

Figure 1:
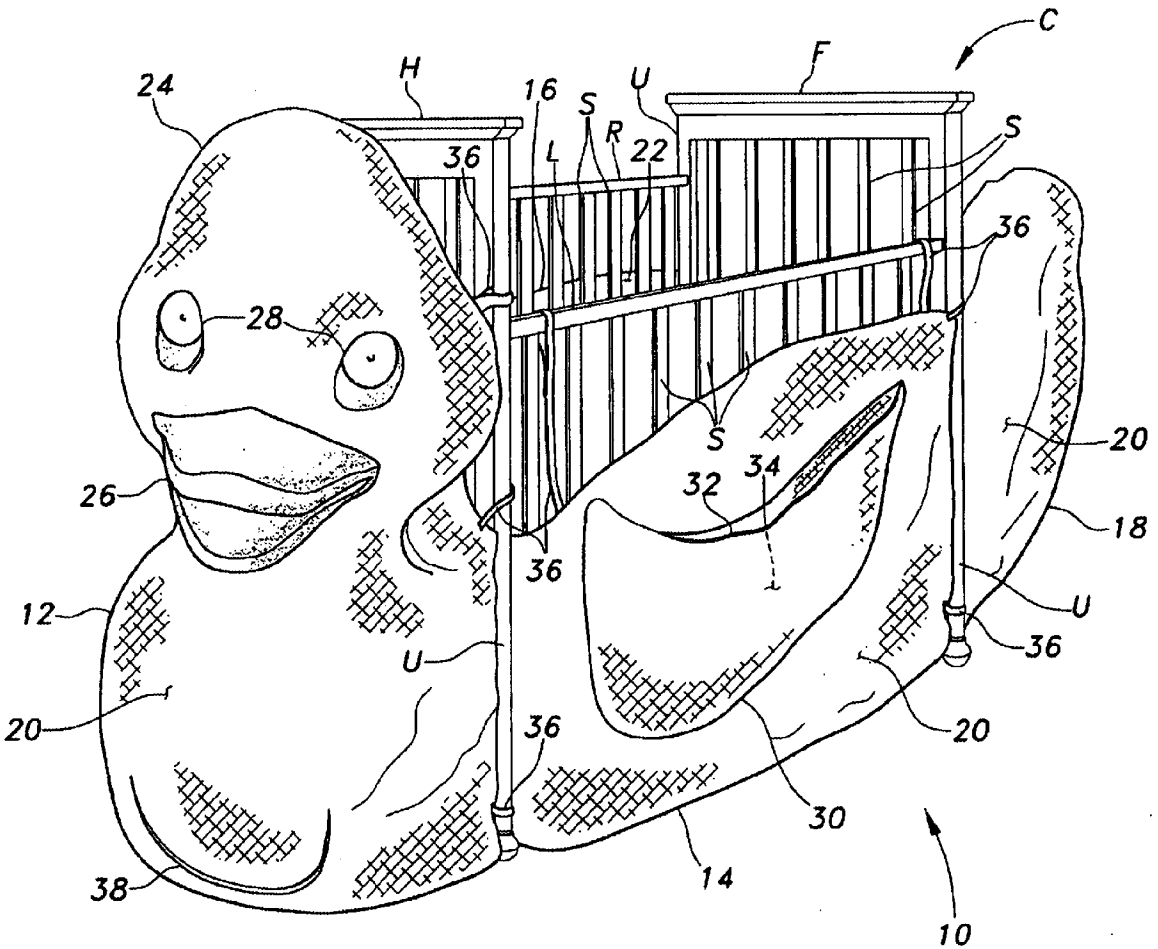
FIG. 1 is an environmental, front left side perspective view of a first embodiment of a baby crib attachment according to the present invention, showing various features thereof.

FIG. 1 of the drawings provides a front and left side perspective view of a first embodiment of the present crib or furniture attachments, removably installed upon a child's crib C. The crib C illustrated in FIG. 1 is conventional, having a rectangular shape with a front or headboard H, an opposite rear or footboard F, and left and right side boards L and R. The various front, rear, and sideboards H, F, L, and R are defined by upright support members U at each corner of the crib C. At least the two side boards L and R, and optionally the head and footboards H and F, are formed of a series of spaced apart vertical slats S, with one or both of the side boards L and R being vertically adjustable as desired. The above described crib construction is generally conventional, and the present attachments are particularly adapted for removable attachment to such a conventional crib C, or other crib configuration.

The attachment 10 of FIG. 1 comprises four separate panels, designated as front panel 12, mirror image left and right side panels, respectively 14 and 16 (the upper edge of the right panel 16 is barely visible on the exterior of the right side R of the crib C in FIG. 1), and rear panel 18. The four panels 12 through 18 are intended for joint or combined installation upon the crib C, and preferably share a common theme, caricature, or representation of some sort. The outer or display surfaces 20 are preferably curved or otherwise shaped to provide the general shape and appearance of the caricature or representation desired, and the opposite, inwardly facing crib or furniture attachment sides or surfaces 22 are substantially flat to facilitate fitting to the flat surfaces of a conventional article of furniture.

In the example of FIG. 1, the attachment 10 is configured to resemble a three dimensional "rubber ducky" caricature, with the front panel 12 having an outwardly extending head portion 24 with bill 26 and eyes 28, the rear panel 18 being curved upwardly and outwardly to have a duck tail appearance, and the two side panels 14 and 16 including representations of wings 30. The wings 30 are preferably additional panels attached to the outer or display surfaces 20 of the two side panels 14 and 16, with an open upper edge 32 to define a storage pocket 34 therein. The openings 32 for these storage pockets 34 are positioned relatively high on the side panels 14 and 16, at a convenient height for an adult caregiver to access infant or child care articles stored within the pockets 34.

Each of the panels 12 through 18 is preferably formed of a relatively soft, flexible, and pliable material. In the case of a "rubber ducky" caricature or representation, the material forming the exterior surfaces 20 of the panels 12 through 18 and the wings 30 may comprise a bright yellow, plasticized material (e.g., oilcloth, etc.), or other flexible material as desired. Preferably, a moisture repellent material is used, in order to resist the absorption of spilled liquids and the like. However, other materials may be used as desired, as each of the panels 12 through 18 may be easily removed from the crib C or other furniture, and cleaned as required.

The preferred three dimensional shape of the present attachments may be achieved with a lightweight fill of a conventional synthetic or natural fiber material, or alternatively by pneumatically inflating each of the panels where the attachment and display surfaces are formed of a plasticized or coated material which is impervious to the passage of air therethrough. Preferably, the two opposite side panels 14 and 16 have a filled or inflated thickness of no more than a very few inches. The use of a very flexible covering material along with a relatively thin thickness for the sides results in the panels being quite soft and pliable, allowing them to be folded out of the way or to collapse upon reaching the floor when the crib sides to which they are attached are lowered. The upper edges of these two side panels 14 and 16 are relatively low, extending no higher than the upper edges of the corresponding crib sides to facilitate rapid access to a child within the crib, if necessary.

Each of the panels 12 through 18 includes a series of furniture or crib attachment straps extending therefrom, generally indicated as straps 36 in FIG. 1. These straps 36 may comprise flexible plastic cable ties passing through grommets conventionally installed about the peripheries of the panels, a heavy or industrial grade of mating hook and loop fabric material (e.g., Velcro®), zippers, snaps, buttons, etc., as desired. Preferably, relatively thin and flexible ties which tie or knot to one another, are not used to secure the panels 12 through 18 in place. Such ties are relatively weak, and can be manipulated by many small children.

Figure 3:
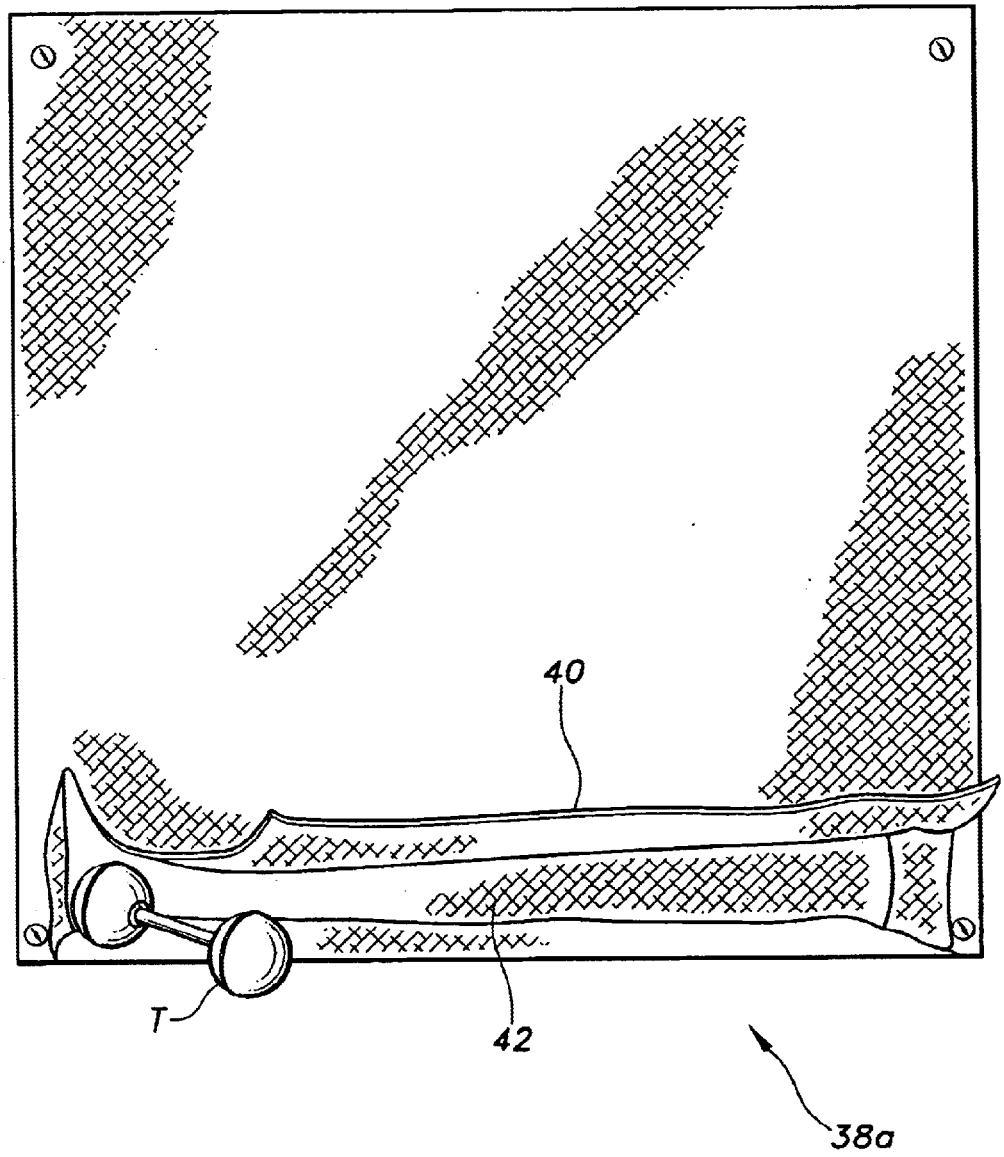
FIG. 3 is a detail elevation view of a lower pocket for access by crawling toddlers or other small children.

At least one additional pocket is provided in the crib attachment assembly 10 of FIG. 1. A lower, child access pocket 38 is located on the lower portion of the front panel 12, for access by crawling toddlers and/or very small children. FIG. 3 provides a detailed illustration of such an exemplary pocket 38*a*, which may be used with the attachment assembly 10 of FIG. 1 or other crib or furniture attachment configuration, as desired. It will be noted that the child access pocket 38*a* includes a flap 40 with a lower edge access opening 42, in order to facilitate access by a crawling toddler or other very small child. Relatively weak and simply opened closures are provided, or alternatively the flap 40 may simply hang over the pocket 38*a*, to allow use by very small children. Various objects, such as a rattle or other toy T, pictures, a mirrored surface, etc., may be installed or stored within the child access pocket(s) 38 and/or 38*a*, for access and use by a toddler or child.

Figure 2:
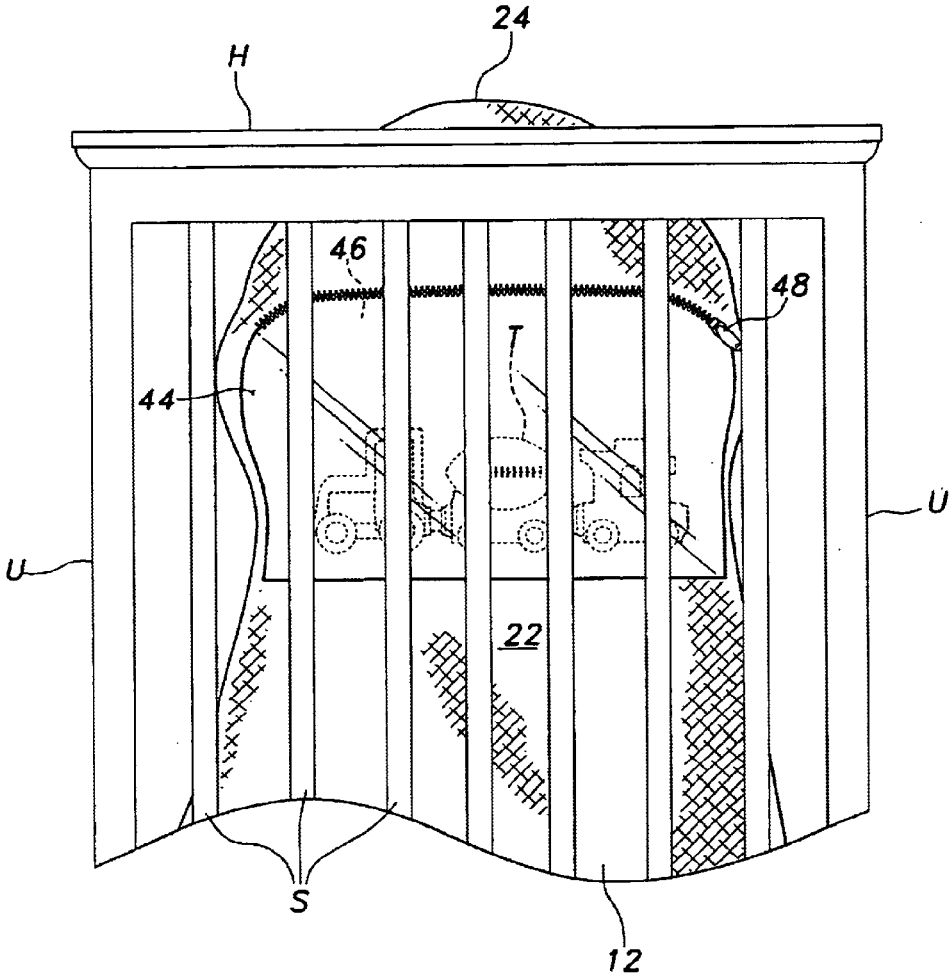
FIG. 2 is a rear elevation view of the forward component of the crib attachment of FIG. 1 from within the crib, showing additional storage and display space within the attachment.

FIG. 2 illustrates additional storage and/or display space which may be provided within the three dimensional volume of the interior of the various panels forming the present crib or furniture attachments. Generally, the front and rear panels have a greater internal volume than do the side panels of the present crib or furniture attachment invention, and accordingly the otherwise unused space within those forward and rearward panels may be utilized. In FIG. 2, a transparent, flexible window panel 44 is provided in the flat furniture or crib attachment surface 22 of the forward panel or component 12 of the attachment assembly 10, or more particularly, in the upper or head portion 24 of the forward panel 12. Various toys T, or alternatively pictures, photos or other displays, a mobile, a mirrored surface, etc. may be placed within the internal compartment 46 enclosed within the upper portion 24 of the front panel 12, to be viewed through the window 44.

The window 44 is oriented toward the headboard H of the crib in order to allow an infant or small child within the crib to view the contents of the storage and/or display area 46. Access to the storage and/or display compartment 46 may be accomplished by means of a zipper closure 48 along the perimeter of the window 44 or other closure means as desired, e.g. snaps, buttons, hook and loop fastener material, etc. The flexibility of the material of which the various panels are formed, enables the front panel 12 to be folded forwardly for access to the window opening 44. Alternatively, access to the compartment 46 may be provided through the front of the forward panel 12, if so desired.

Figure 4:
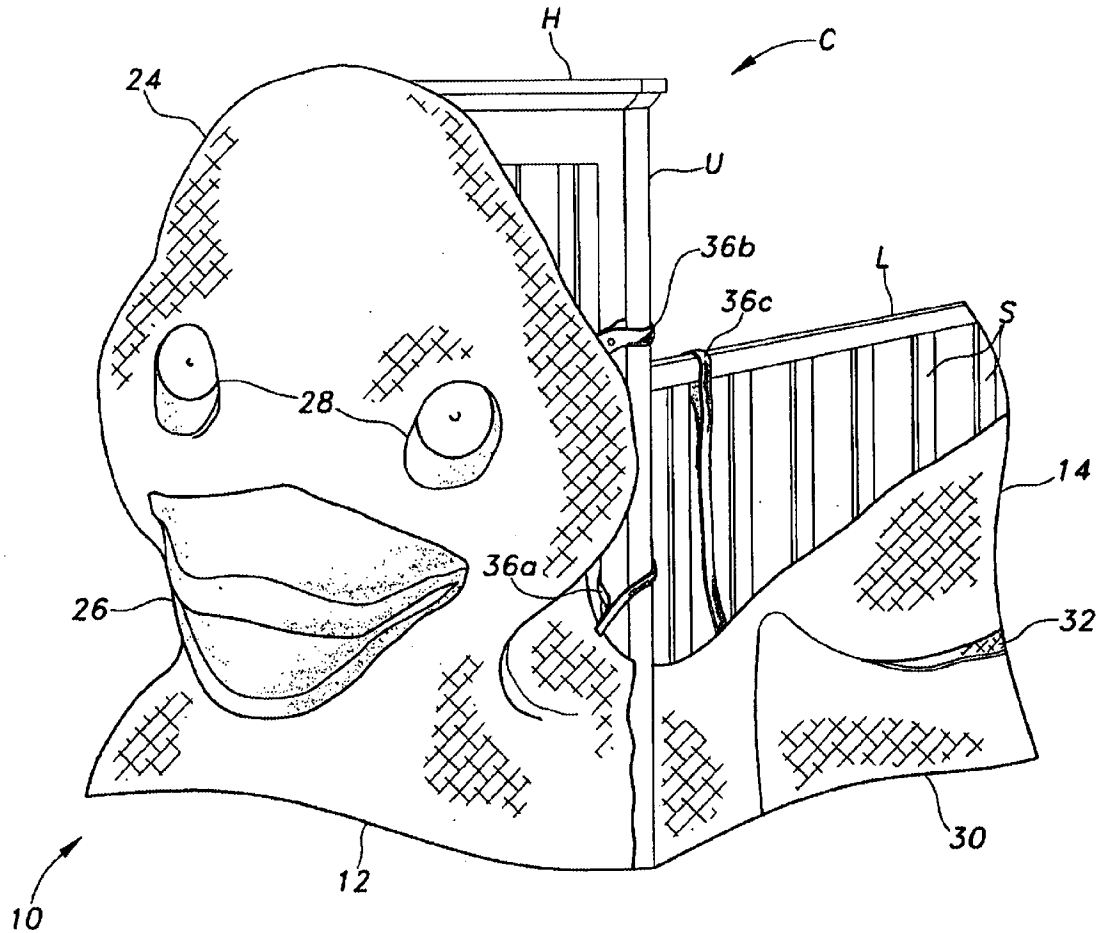
FIG. 4 is a detail perspective view of a portion of the front and left side attachments of the embodiment of FIG. 1, showing details of the panel to crib attachments.

FIG. 4 provides an illustration of the various types of attachment straps which may be used to secure any of the panels 12 through 18 to the crib C or other structure as desired. It will be understood that normally, a single type of fastener would be used to secure all of the various panels to a crib or other structure. However, several different types of fasteners are illustrated in FIG. 4, in order to indicate the broad range of fastening means available to secure the present attachment panels to another structure.

A first fastener 36*a*, shown just below the left side of the head 24 of the front panel 12 caricature, comprises a plastic cable tie or the like, which may be passed through conventional grommets (not shown) installed about the periphery of each panel. Alternatively, a strap 36*b* having a snap or button therein, may be secured about a convenient upright U or slat S, as desired. Such a snap or button attachment strap 36*b* is shown above the strap 36*a*. Another alternative is the use of mating hook and loop fastening material (i.e., Velcro®) in a strap 36*c*, shown looped over the upper rail of the left side board L of the crib C. Various other means for fastening the panels to the crib C or other article of furniture, e.g., conventional zippered sleeve attachments, etc., may be provided as desired.

Figure 5:
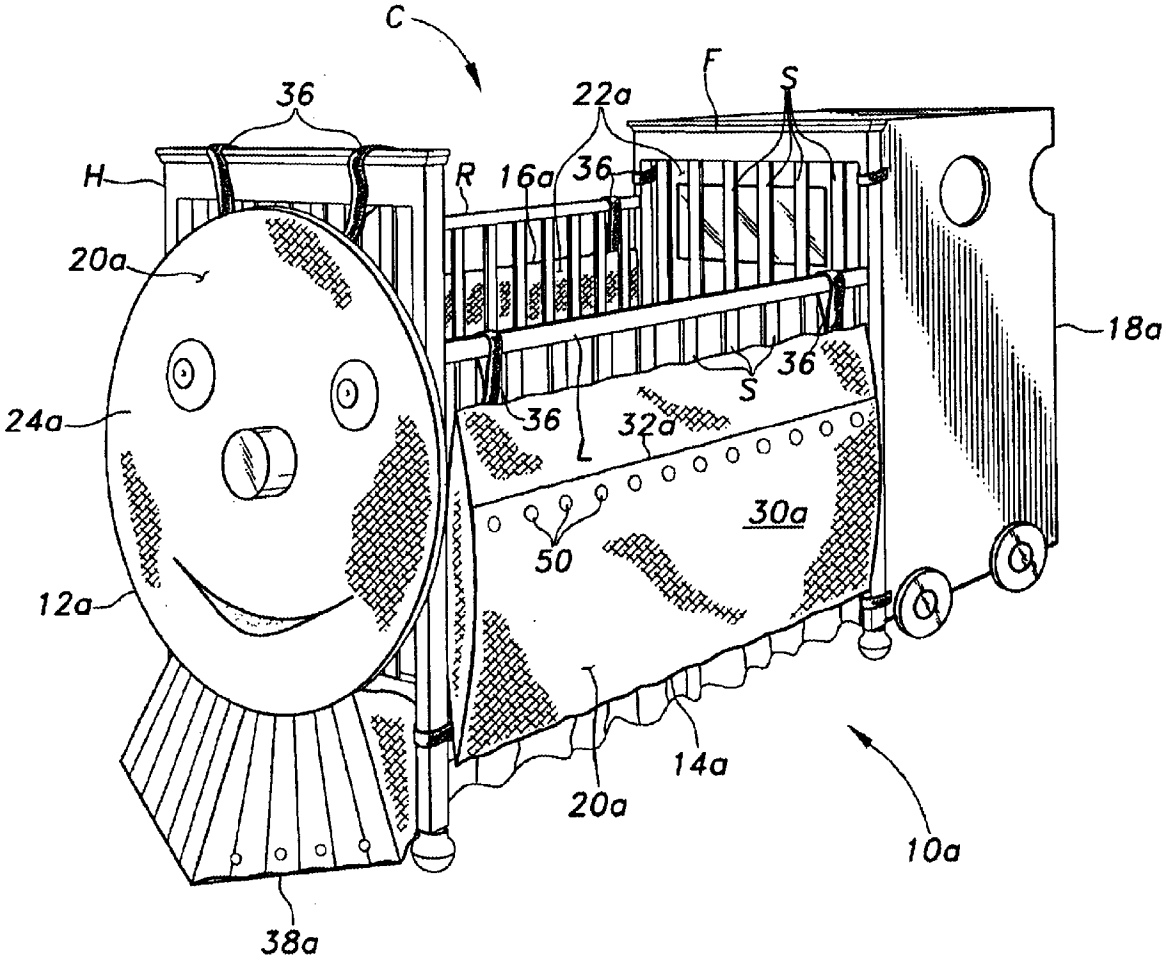
FIG. 5 is a front left side perspective view of an alternative embodiment of the present crib attachments, representing a railroad train engine caricature and storage area.

FIG. 5 provides an illustration of another embodiment 10*a* of the present invention, comprising a series of panels

12*a* through 18*a* forming a representation or caricature of a railroad steam locomotive. The steam engine theme attachment assembly 10*a* is structurally similar to the "rubber ducky" theme attachment assembly 10 shown in FIG. 1, having front, rear, left, and right side panels, respectively 12*a* through 18*a*. Each panel 12*a* through 18*a* includes an outwardly facing or display side or surface 20*a*, and an opposite inwardly facing, crib or furniture attachment side or surface 22*a*. The front panel 12*a* may comprise a caricature 24*a* of a personified railroad train steam engine or the like, with the two side panels 14*a* and 16*a* representing the sides of the engine and the rear panel 18*a* representing the cab. The cab representation of the rear panel 18*a* lends itself to use as a storage area as well, due to the interior volume provided. The rear panel structure may be formed of rigid materials for use as a storage area, or may alternatively be formed of soft, flexible materials, as in the case of other panels comprising the present crib or furniture attachments.

The side panels 14*a* and 16*a* may include adult accessible pockets 30*a* installed thereon, with closure buttons or snaps 50 (resembling rivets along the side of the engine) being provided adjacent the upper edge 32*a*, if so desired. Straps 36, using the same attachment means described further above for the embodiment shown in FIG. 1, are used to secure the various panels 12*a* through 18*a* to the corresponding sides H, F, L, and R of the crib C. Also, one or more of the panels 12*a* through 18*a* may include a lower pocket 38*a* accessible by a crawling toddler or very small child, similar to the embodiment 10 illustrated in FIG. 1. The railroad engine theme panels 12*a* through 18*a* of FIG. 5 are exemplary, and it will be seen that innumerable other themes may be developed in keeping with the present invention.

Figure 6:
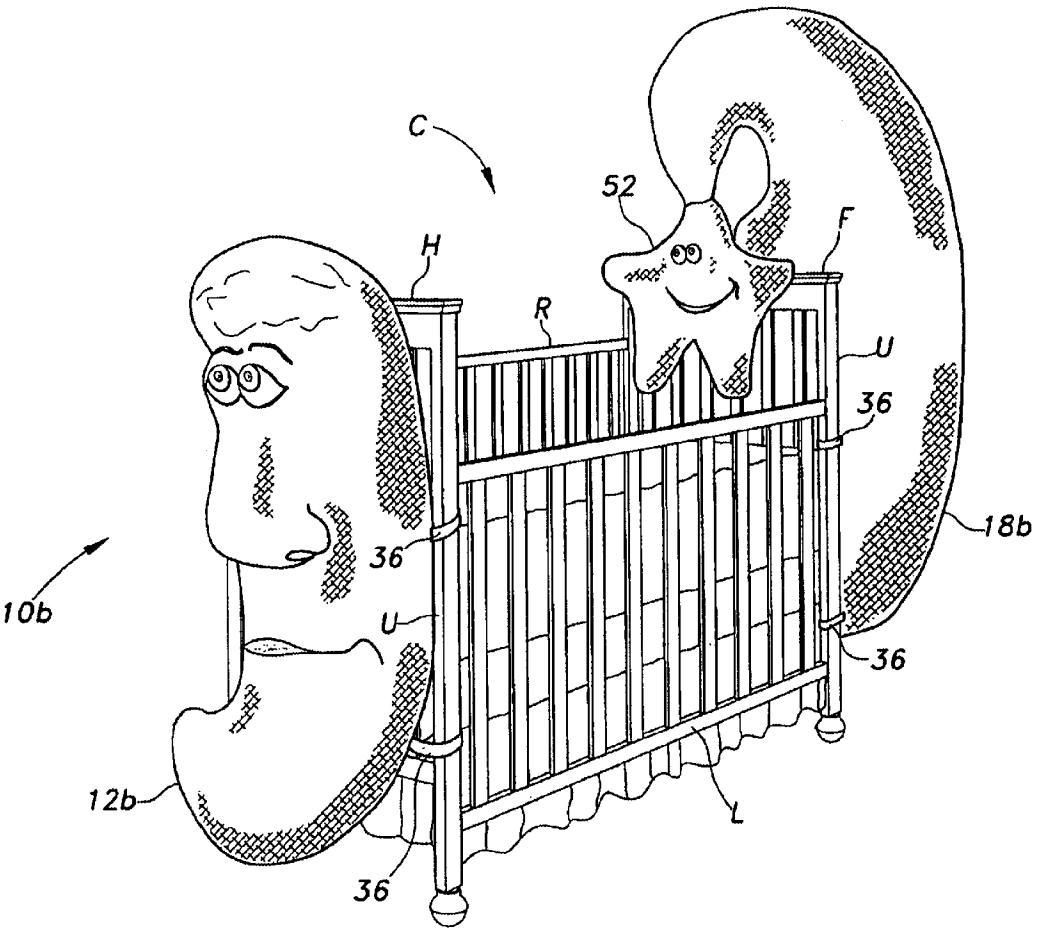
FIG. 6 is a front left side perspective view of another embodiment of the present crib attachments, representing crescent moon and star caricatures.

FIG. 6 of the drawings illustrates yet another embodiment of the present crib or furniture attachments, comprising panel assembly 10*b* having respective front and rear panels 12*b* and 14*b* which resemble caricatures of crescent moons or the like. While no side panels are shown attached to the crib C of FIG. 6, it will be seen that various side panel configurations of stars, planets, or other elements may be added to the left and right side boards L and R of the crib C of FIG. 6, if so desired. The two end panels 12*b* and 18*b* are removably secured to the respective head board H and foot board F of the crib C by straps 36, as in the forward and rearward end panels of the embodiments illustrated in FIGS. 1 and 5. While no adult or child accessible pockets are illustrated in the panels 12*b* and 18*b* of FIG. 6, it will be seen that such pockets may be added to the crescent moon caricature panels shown in FIG. 6, if so desired, by using the mouth feature of the caricature, or other area as desired.

FIG. 6 also illustrates the addition of a mobile 52, having the configuration of a five pointed star caricature. Such a mobile may be used in combination with any of the other embodiments of the present invention, if so desired. Preferably, the mobile is formed of an inflated container, in order to avoid undue weight and mass. The very light weight of such inflated structures allows its attachment to the overhanging portion of the supporting end panel, e.g. rear panel 18*b*, by means of conventional hook and loop fastener material, in order to avoid the use of small, hard or sharp objects where an infant or small child may be able to reach them.

Figure 7:
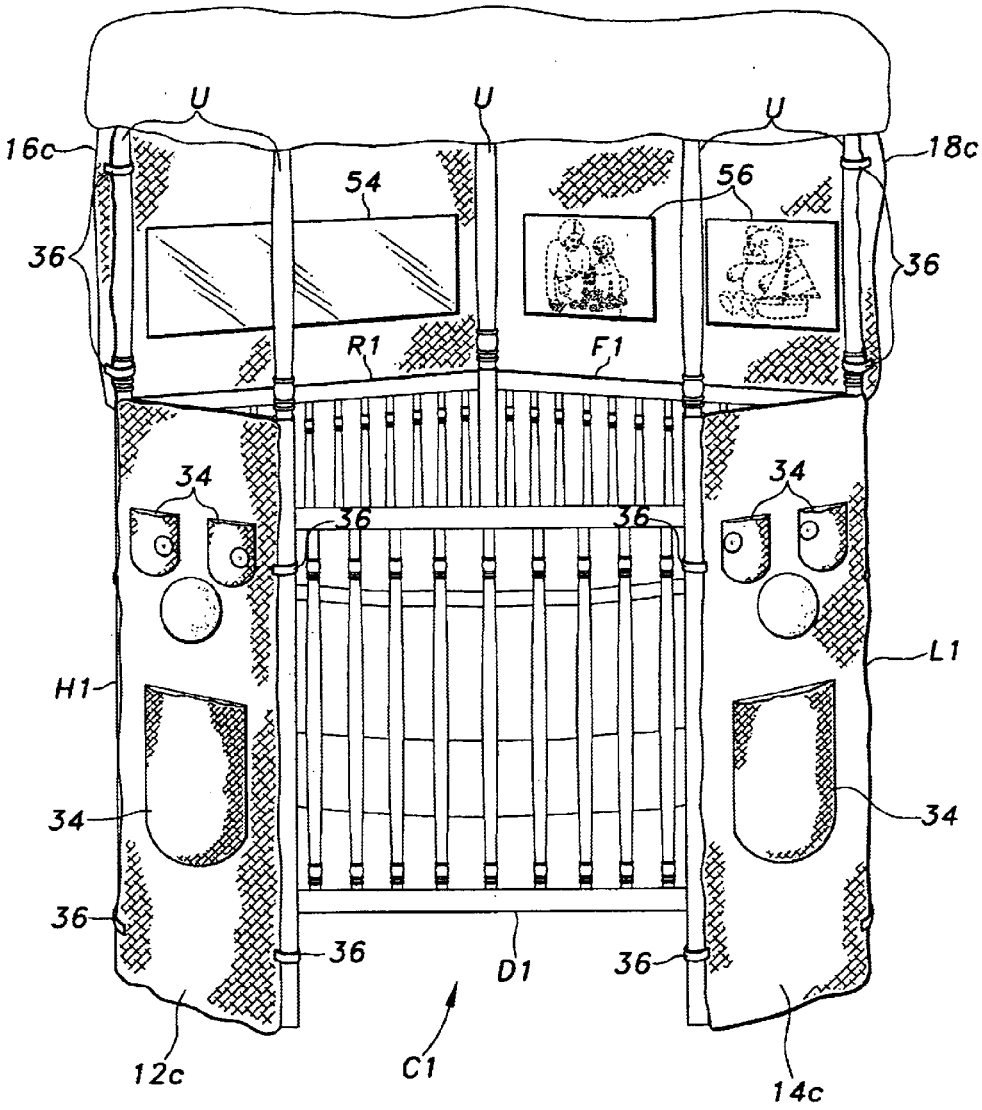
FIG. 7 is a front perspective view of yet another embodiment of the present crib attachments, showing a series of panels removably installed upon a corner crib having a diagonal front.
Figure 8:
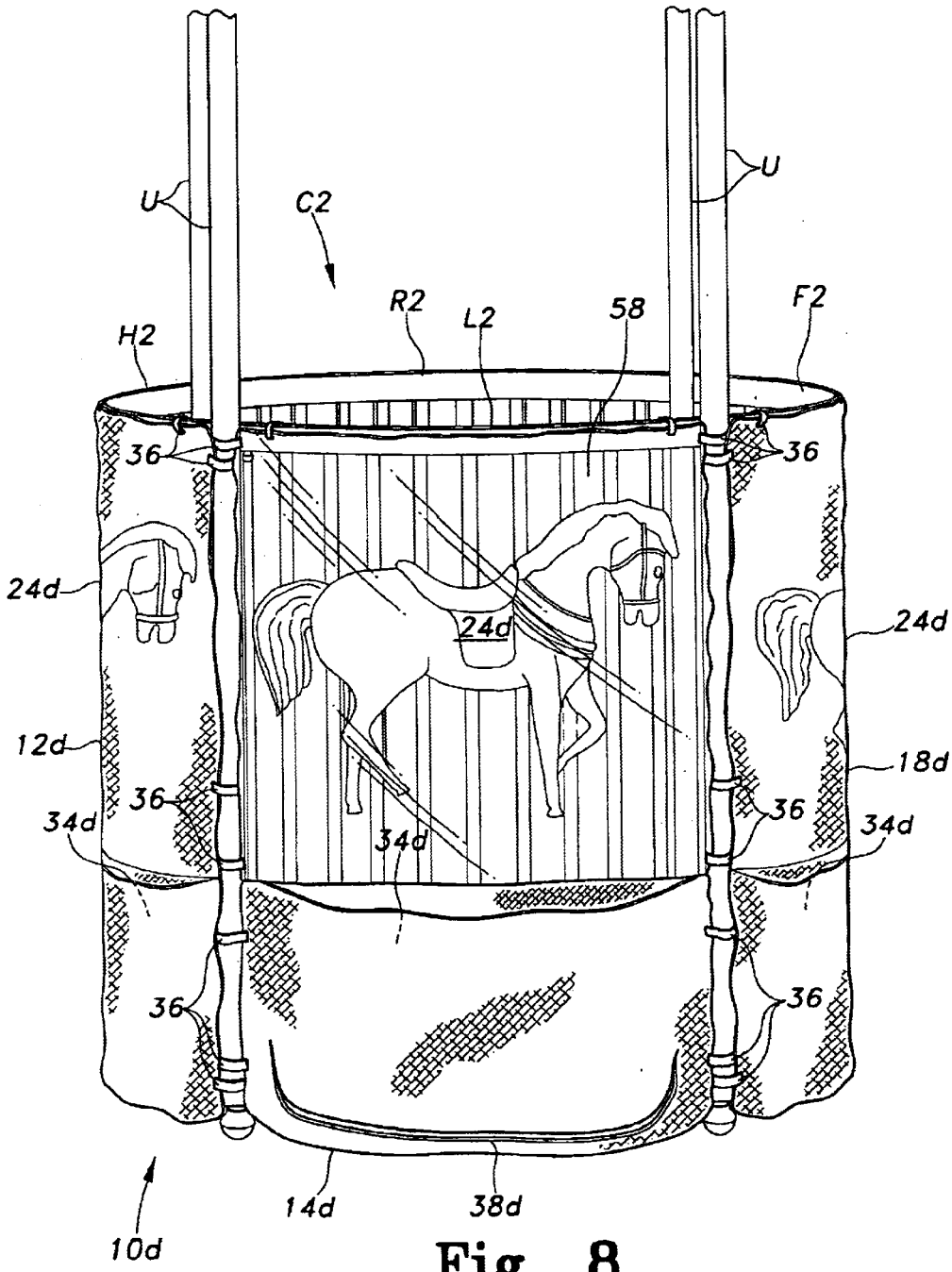
FIG. 8 is a front perspective view of still another embodiment of the present crib attachments, showing a series of panels removably installed upon a round or circular crib.

FIGS. 7 and 8 illustrate applications of the present crib or furniture attachments to non-standard cribs having other than rectangular shapes. In FIG. 7, a corner crib C1 is formed of a series of mutually orthogonal boards, designated as headboard H1, footboard F1, and left and right side boards L1 and R1. In addition, a diagonal board member D1 extends between the relatively short headboard H1 and left side board L1. Each of these boards is defined by a pair of uprights U, which extend above the head, foot, and side boards to support a canopy.

As the corner crib C1 is intended for placement in a corner where two of the sides will not be visible, only the head board H1 and left side board L1 are provided with externally facing caricature panels, respectively panels 12*c* and 14*c*. These panels 12*c* and 14*c* may be provided with adult accessible pockets 34, as shown, and/or other pockets (not shown) as desired. Attachment straps 36 are used to secure the panels 12*c* and 14*c* to the uprights U, as in the other embodiments discussed further above.

The relatively tall uprights U of the corner crib C1 of FIG. 7, provide an additional benefit for the present furniture attachments. A series of inwardly facing display panels, respectively right side panel 16*c* and foot board panel 18*c*, may be provided to extend upwardly to the upper ends of their respective support uprights. These display panels 16*c* and 18*c* would normally be positioned along two adjacent walls and their common corner, so no exterior caricatures are required. However, a series of inwardly facing displays, e.g. a mirror 54 and photos or pictures 56 may be provided on the display panels 16*c* and 18*c*.

FIG. 8 illustrates still another crib configuration, comprising a round or circular crib C2. The circular crib C2 includes a headboard H2, opposite footboard F2, and left and right side boards L2 and R2, but rather than being straight or planar panels, these crib boards form semicircular segments which form a circular shape when joined together at their mutual uprights U.

The present crib or furniture attachment invention takes advantage of this round crib configuration by providing a series of panels 10*d* having a merry-go-round or carousel theme. In FIG. 8, a front panel 12*d*, left side panel 14*d*, right side panel (not shown), and rear panel 18*d* are installed about the four head, foot, and side boards of the crib C2, and secured to the uprights U by means of straps 36, as in the case of the other crib attachment embodiments of the present invention. The various attachment panels preferably include a series of carousel animals 24*d* thereon, e.g., carousel horses, or perhaps other fanciful animals as desired. Preferably, at least one of the panels, e.g. the left side panel 14*d*, includes a transparent window 58 therein, to facilitate viewing an infant or child within the crib C2, and/or to allow the infant or child to see outwardly from the crib C2. As in the other embodiments of the present invention, relatively high adult access pockets 34*d* may be placed about the various panels, with lower, bottom opening toddler access pockets 38*d* being provided along the lower edge(s) of at least one of the panels.

In conclusion, the present crib or furniture attachments provide a most attractive means of decorating or dressing up a crib, cradle, or other furniture in a child's room or nursery. The present attachments also provide several utilitarian functions as well, with their adult accessible pockets for the storage of various articles needed by a parent or adult caregiver of a small child. The lower, toddler accessible pockets also provide utility in that they encourage exploration and manipulation of the pockets in a safe manner for toddlers and other small children. The various embodiments of the present attachments may be mixed and matched as desired to alter the themes presented, or may be applied to provide a uniform theme or caricature to a crib or other article of furniture, as desired. The additional provision for mirrors, photographs, pictures, and/or transparent windows, add further utility and value to the present attachments. Accordingly, the present crib or furniture attachments will prove to be a most desirable accessory in children's rooms, nurseries, and the like.

It is to be understood that the present invention is not limited to the embodiments described above, but encompasses any and all embodiments within the scope of the following claims.

We claim:

1. A furniture attachment, comprising:

at least one soft, pliable, flexible, decoratively themed furniture attachment panel having a substantially flat furniture attachment side and an outwardly extending display side, defining a three dimensional volume therebetween;

a plurality of furniture attachment straps extending from said at least one panel;

at least one upper, adult access storage pocket disposed upon the display side of said at least one panel; and at least one inwardly facing display disposed upon the furniture attachment side of said at least one panel.

2. The furniture attachment according to claim 1, wherein:

said at least one furniture attachment panel comprises a plurality of panels; and said plurality of panels further have a thematically related configuration and form a coherent theme when said plurality of panels is removably attached to an article of furniture.

3. The furniture attachment according to claim 1, further including:

at least one lower child access pocket disposed upon said display side of said at least one panel; and said at least one child access pocket having a lower edge with an access opening disposed therealong.

4. The furniture attachment according to claim 1, wherein said at least one panel has a configuration adapted for removable attachment to a child's crib.

5. The furniture attachment according to claim 1, further including:

an internal storage and display compartment disposed within said at least one panel; and a transparent storage and display compartment window disposed upon said furniture attachment side of said at least one panel, for viewing any contents of said storage and display compartment from said furniture attachment side of said at least one panel.

6. The furniture attachment according to claim 1, wherein said three dimensional volume of said at least one panel is substantially filled by padding material disposed therein.

7. The furniture attachment according to claim 1, wherein the three dimensional volume of said at least one panel is substantially filled by pneumatic inflation.

8. The furniture attachment according to claim 1, wherein said plurality of removable furniture attachment straps further includes fasteners selected from the group consisting of plastic ties, hook and loop fabric material, zippers, snaps, and buttons.

9. The furniture attachment according to claim 1, further including a child's crib, selected from the group consisting of rectangular, corner, and round cribs.

10. A child's crib and a crib attachment therefor, comprising in combination:

a crib having a plurality of side panels, a corresponding plurality of upright support members disposed between said side panels, and a plurality of spaced apart bars disposed within each of said side panels, the side panels defining an interior of said crib and an exterior of said crib;

at least one soft, pliable, flexible, decoratively themed crib attachment panel removably installed upon the exterior of said crib, the panel having a substantially flat, crib attachment side abutting said side panels of said crib and an outwardly extending display side facing outward from said crib and defining a three dimensional volume therebetween;

a plurality of crib attachment straps extending from said at least one panel; and at least one upper, adult access storage pocket disposed upon the display side of said at least one panel.

11. The child's crib and crib attachment combination according to claim 10, wherein:

said at least one crib attachment panel comprises a plurality of panels; and said plurality of panels further have a thematically related configuration and form a coherent theme when said plurality of panels is removably attached to said crib.

12. The child's crib and crib attachment combination according to claim 10, further including:

at least one lower child access pocket disposed upon said display side of said at least one panel, said at least one child access pocket having a lower edge with an access opening disposed therealong.

13. The child's crib and crib attachment combination according to claim 10, further including:

an internal storage and display compartment disposed within said at least one panel; and a transparent storage and display compartment window disposed upon said crib attachment side of said at least one panel, for viewing any contents of said storage and display compartment from said crib attachment side of said at least one panel.

14. The child's crib and crib attachment combination according to claim 10, further including at least one inwardly facing display disposed upon the crib attachment side of said at least one panel.

15. The child's crib and crib attachment combination according to claim 10, wherein the three dimensional volume of said at least one panel is substantially filled by padding material disposed therein.

16. The child's crib and crib attachment combination according to claim 10, wherein said three dimensional volume of said at least one panel is substantially filled by pneumatic inflation.

17. The child's crib and crib attachment combination according to claim 10, wherein said plurality of crib attachment straps further includes fasteners selected from the group consisting of plastic ties, hook and loop fabric material, zippers, snaps, and buttons.

18. The child's crib and crib attachment combination according to claim 10, wherein said crib has a shape selected from the group consisting of rectangular, corner, and round cribs.

19. A baby crib attachment for an exterior of a crib, comprising:

at least one soft, pliable, flexible, decoratively themed attachment panel having a substantially flat crib attachment side and an outwardly extending display side, defining a three dimensional volume therebetween;

means for attaching the at least one attachment panel upon the exterior of the crib so that the at least one attachment panel is adapted for covering at least a portion of the exterior of the crib; and at least one upper adult access storage pocket disposed upon the display side of the at least one panel so that the pocket is inaccessible to an infant within the crib while being easily accessible to the adult.

* * * * *